US008449403B2

(12) United States Patent
Mitsumoto

(10) Patent No.: US 8,449,403 B2
(45) Date of Patent: May 28, 2013

(54) SUPPORT FOR GOLF CLUB

(75) Inventor: Masashi Mitsumoto, Tokyo (JP)

(73) Assignee: Nikken Industry Co., Ltd. (JP)

( * ) Notice: Subject to any disclaimer, the term of this patent is extended or adjusted under 35 U.S.C. 154(b) by 203 days.

(21) Appl. No.: 12/922,219

(22) PCT Filed: Jan. 30, 2009

(86) PCT No.: PCT/JP2009/051559
§ 371 (c)(1),
(2), (4) Date: Oct. 25, 2010

(87) PCT Pub. No.: WO2009/113336
PCT Pub. Date: Sep. 17, 2009

(65) Prior Publication Data

US 2011/0034264 A1 Feb. 10, 2011

(30) Foreign Application Priority Data

Mar. 13, 2008 (JP) ..... 2008-063971

(51) Int. Cl.
*A63B 55/00* (2006.01)

(52) U.S. Cl.
USPC ..... 473/282; 211/70.2; 248/214; 248/316.1

(58) Field of Classification Search
USPC ..... 473/282; D21/796; 211/70.2; 206/315.6, 206/315.2, 315.4; 248/214, 316.1
See application file for complete search history.

(56) References Cited

U.S. PATENT DOCUMENTS

D306,056 S * 2/1990 Tucker ..... D21/796
D348,712 S * 7/1994 Parker, Jr. ..... D3/221

(Continued)

FOREIGN PATENT DOCUMENTS

JP 2004-136069 5/2004
JP 2006-223867 8/2006

(Continued)

OTHER PUBLICATIONS

English translation of the International Preliminary Report on Patentability which issued in connection with corresponding PCT Application No. PCT/JP2009/051559 on Nov. 2, 2010.

*Primary Examiner* — Stephen L. Blau
(74) *Attorney, Agent, or Firm* — Clark Hill PLC

(57) ABSTRACT

Provided is a golf club support on which a wooden club, etc. can be suspended in a desired direction while being prevented from falling or tumbling. The golf club support for supporting a golf club of which head portion has an R shape on a base end side has a columnar shape, has an opening 10 in the circumferential surface thereof, and has a guide portion 12 which is formed from the opening toward the inside. A first support member 16, a second support member 18, and a third support member 20 are formed on at least the top surface of the golf club support. When a golf club is positioned at an innermost portion 12A of the guide portion with a sole surface of its head portion turned upward, the first support member 16 supports a face surface 32A of the head portion of the golf club, the second support member 18 supports a surface 32B facing obliquely outward and upward in the base-end-side side surface of the head portion of the golf club, and the third support member 20 supports a top surface 32D of the head portion of the golf club on its top end. The positions of the top portions of the first support member and the second support member are higher than the top portion of the third support member.

7 Claims, 6 Drawing Sheets

U.S. PATENT DOCUMENTS

| | | | | |
|---|---|---|---|---|
| D535,347 | S * | 1/2007 | Cialdella et al. | D21/796 |
| 7,896,173 | B2 * | 3/2011 | Yamamoto et al. | 211/70.2 |
| D647,255 | S * | 10/2011 | Enervold et al. | D30/199 |
| 8,177,077 | B2 * | 5/2012 | Yamamoto et al. | 211/70.2 |
| 2007/0193965 | A1 * | 8/2007 | Cialdella et al. | 211/70.2 |
| 2010/0147785 | A1 * | 6/2010 | Yamamoto et al. | 211/85.7 |
| 2011/0053699 | A1 * | 3/2011 | Kaufman | 473/236 |

FOREIGN PATENT DOCUMENTS

| | | |
|---|---|---|
| JP | 2008-080080 | 4/2008 |
| WO | WO 2006077699 A1 * | 7/2006 |

* cited by examiner

SUPPORT FOR GOLF CLUB

TECHNICAL FIELD

The present invention relates to a golf club support for use in a shop, etc. for displaying a golf club such as a wooden club and a utility club that has an R shape on a base end side.

BACKGROUND ART

In shops such as golf shops, etc., wooden clubs and iron clubs are conventionally displayed on a shelf, etc. When displaying a golf club such as a wooden club and a utility club that has an R shape on the base end side, the golf club is hung on and suspended from a support with the sole surface (bottom surface) of its head portion turned upward. Such a golf club support is described in Patent Document 1.

The golf club support described in Patent Document 1 has a recessed support portion for receiving the top surface (i.e., the surface opposite to the sole surface) of the head portion of a wooden club, etc. on its continuous surface, and supports the wooden club, etc. by suspending the head portion of the wooden club on the support portion.

Patent Document 1: JP2006-223867A

DISCLOSURE OF THE INVENTION

Problem to be Solved by the Invention

However, judging from that customers, who pick up a wooden club, etc. for examination, sometimes return the wooden club, etc. to the support portion with the head portion facing in a direction different from a desired direction, the golf club support described in Patent Document 1, which is configured to merely receive the top surface of the head portion of a wooden club, etc. on its continuous surface, has a problem that it allows the club to be suspended with the head portion facing the different direction.

Hence, an object of the present invention is to provide a golf club support on which a wooden club, etc. can be suspended in a state that the wooden club, etc. faces a desired direction, even when a customer returns the wooden club, etc. to its support portion in a direction different from the desired direction.

Means for Solving the Problem

To achieve the above object, a golf club support according to the present invention for supporting a golf club of which head portion has an R shape on a base end side is characterized in that the golf club support has a columnar shape, has an opening which extends from a top end to a bottom end in a circumferential surface thereof, and has a guide portion which is formed from the opening toward the inside to be able to guide a shaft of the golf club therein, wherein a first support member, a second support member, and a third support member are formed on at least a top surface of the golf club support such that when the golf club is positioned at an innermost portion of the guide portion with a sole surface of its head portion turned upward, the first support member supports a face surface of the head portion of the golf club, the second support member supports a surface facing obliquely outward and upward in the base-end-side side surface of the head portion of the golf club, and the third support member supports a top surface of the head portion of the golf club on a top end thereof, and wherein the positions of top portions of the first support member and the second support member are higher than a top portion of the third support member. In the golf club support according to the present invention, the top or the bottom of a wooden club means the top or the bottom thereof in its normal service condition, i.e., a condition in which the sole surface of its head portion faces downward. Hence, since a wooden club is supported with the sole surface of its head portion turned upward, for example, the term "obliquely upward" used for the base-end-side side surface of the head portion means "downward" when the wooden club is supported.

As described above, according to the golf club support of the present invention, the third support member supports the top surface of the head portion of the wooden club, the first support member supports the face surface of the head portion of the wooden club having an inclination in an obliquely outward and upward direction, and the second support member supports the surface facing obliquely outward and upward in the base-end-side side surface of the head portion of the golf club, whereby the wooden club can be supported in a balanced suspended state. Meanwhile, the top portions of the members for supporting the face surface and the base-end-side side surface of the head portion are higher than that of the member for supporting the top surface of the head portion. Therefore, even if, for example, the top surface of the head portion is placed on the top end of the first support member or the second support member, as long as the position of contact of the first support member or the second support member is distal from the topmost portion of the top surface of the head portion, the head portion slides down toward the third support member to be supported by the third support member. In this way, by paying attention to that the face surface of the head portion faces obliquely outward and upward and the base-end-side side surface of the head portion has an R shape that projects toward the base end, the golf club support according to the present invention is configured such that when a wooden club is suspended thereon with the head portion turned upward, the golf club support supports these surfaces at a positions higher than the top surface of the head portion, thereby ensuring that even when the wooden club is suspended with the head portion facing a direction different from a desired direction, the top surface of the head portion slides down toward the member for supporting the top surface of the head portion. The first support member, the second support member, and the third support member have a function of supporting the respective portions, and a function of turning the head portion to come to a desired position.

In the golf club support according to the present invention, it is preferred that a tapered surface that faces obliquely inward and upward be formed on an inner side of a top end of the first support member, and the golf club support be configured to support the face surface on the tapered surface. By providing such a tapered surface, it becomes possible to support a wooden club in a more balanced suspended state. Here, the term "inner side" of the first support member is used to mean not only an inner surface, but also a situation that a tapered surface is formed by, for example, chamfering sides of the inner surface and a side surface of the first support member. It is preferred to give an angle to the tapered surface in accordance with the face surface of the head portion to be supported.

In the golf club support according to the present invention, it is preferred that a fourth support member, a fifth support member, and a sixth support member be formed on a bottom surface of the golf club support such that when the golf club is positioned at the innermost portion of the guide portion with the sole surface of its head portion turned upward, the fourth support member supports the face surface of the head portion of the golf club, the fifth support member supports the surface facing obliquely outward and upward in the base-end-side side surface of the head portion of the golf club, and the sixth support member supports the top surface of the head portion of the golf club on a top end thereof, and that the fourth support member, the fifth support member, and the sixth support member be formed at positions at which they are symmetrical with the first support member, the second support member, and the third support member respectively. In this case, it is preferred that the golf club support be configured to be able to support with the top surface or the bottom surface thereof turned upward. By providing the fourth support member, the fifth support member, and the sixth support member symmetrical with the first support member, the second support member, and the third support member respectively on the bottom surface of the golf club support, it is possible to use the top surface as a wooden club support for right-handers and the bottom surface as a wooden club support for left-handers. The symmetrical positions need not be completely symmetrical positions, but may be positions somewhat deviated from the completely symmetrical positions as long as such positions can provide such an effect as above.

In the golf club support according to the present invention, it is preferred that at least three support poles project upward from the top surface of the golf club support, and that among the at least three support poles, a first support pole functions as the first support member, a second support pole functions as the second support member, and the support pole other than the first support pole and the second support pole functions as the third support member. In this case, it is preferred that the first support pole and the second support pole have different heights. Further, it is preferred that the first support pole and the second support pole be positioned closer to both edges of the opening respectively than the support pole other than them is. By providing the first support pole and the second support pole which support the head portion from an approximately horizontal direction such that they are closer to both edges of the opening than the remaining support pole is, it is possible to prevent a golf club from slipping off from the support even when a force is applied to the head portion in the direction toward the opening. Furthermore, it is preferred that the leading ends of the at least three support poles be formed into an R shape or a sharpened shape. By providing different heights to the first support pole and the second support pole, it is possible to prevent the head portion of a wooden club from being placed on the first support pole and the second support pole.

In the golf club support according to the present invention, it is preferred that a rim conforming to the shape of the guide portion project upward from the top surface of the golf club support, and that the rim have a first support portion functioning as the first support member, a second support portion functioning as the second support member, and a third support portion functioning as the third support member. In this case, it is preferred that the first support portion and the second support portion be positioned closer to both edges of the opening respectively than the third support portion is.

Effect of the Invention

As described above, according to the present invention, it is possible to provide a golf club support on which a wooden club can be suspended in a state that the wooden club faces a desired direction, even when a customer returns the wooden club to its support portion in a direction different from the desired direction.

BEST MODE FOR CARRYING OUT THE INVENTION

Figure 1:
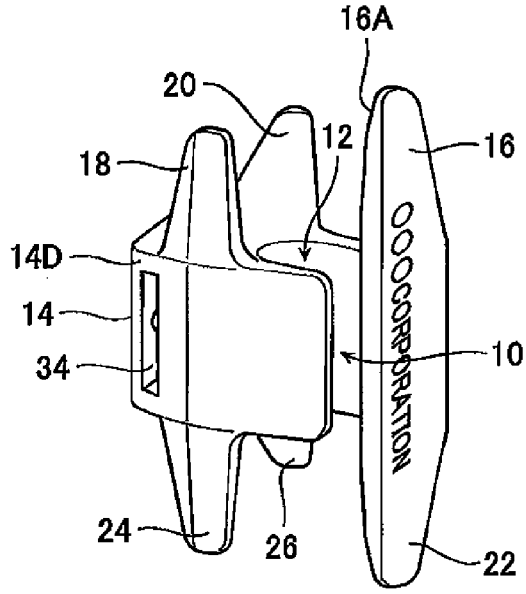
FIG. 1 is a perspective view of a first embodiment of a golf club support according to the present invention.
Figure 2:
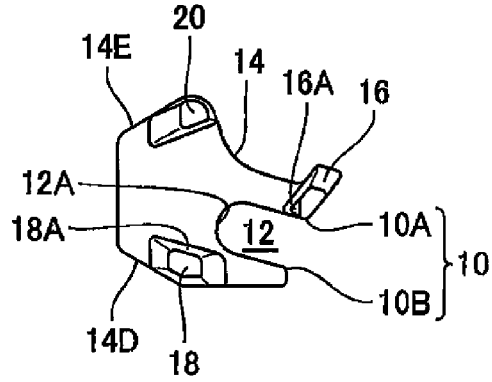
FIG. 2 is a top view of the golf club support according to the first embodiment.
Figure 3:
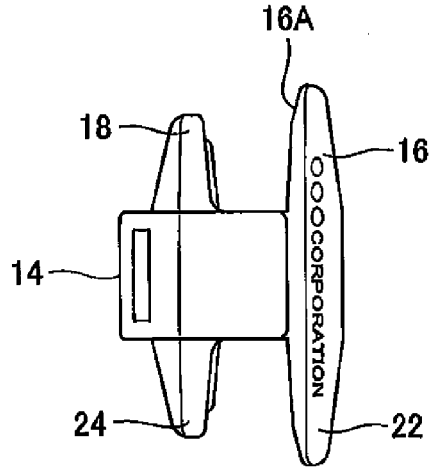
FIG. 3 is a front view of the golf club support according to the first embodiment.
Figure 4:
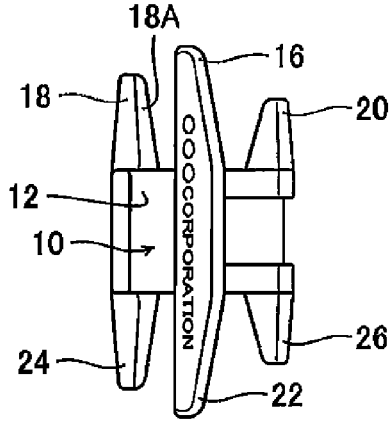
FIG. 4 is a right side view of the golf club support according to the first embodiment.
Figure 5:
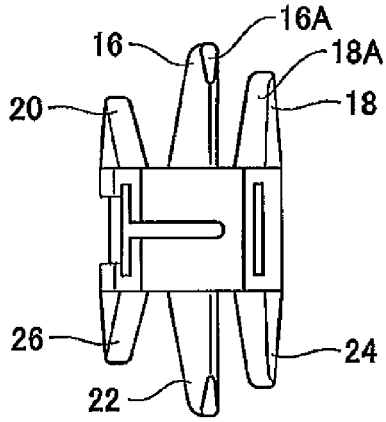
FIG. 5 is a left side view of the golf club support according to the first embodiment.

Next, a first embodiment of a golf club support according to the present invention will be explained. FIG. 1 is a perspective view of a wooden club support according to the first embodiment. FIG. 2 is a top view thereof. FIG. 3 is a front view thereof. FIG. 4 is a right side view thereof. FIG. 5 is a left side view thereof.

The wooden club support according to the first embodiment includes: a support body 14 having a columnar shape; first, second, and third three support poles 16, 18, and 20 projecting upward from the top surface of the support body 14; and fourth, fifth, and sixth three support poles 22, 24, and 26 projecting downward from the bottom surface of the support body 14. The support body 14 has an opening 10 which extends from the top end to the bottom end in the circumferential surface thereof. The support body 14 has a guide portion 12 which is formed from the opening 10 toward the inside to be able to guide a shaft of a golf club therein.

Figure 6:
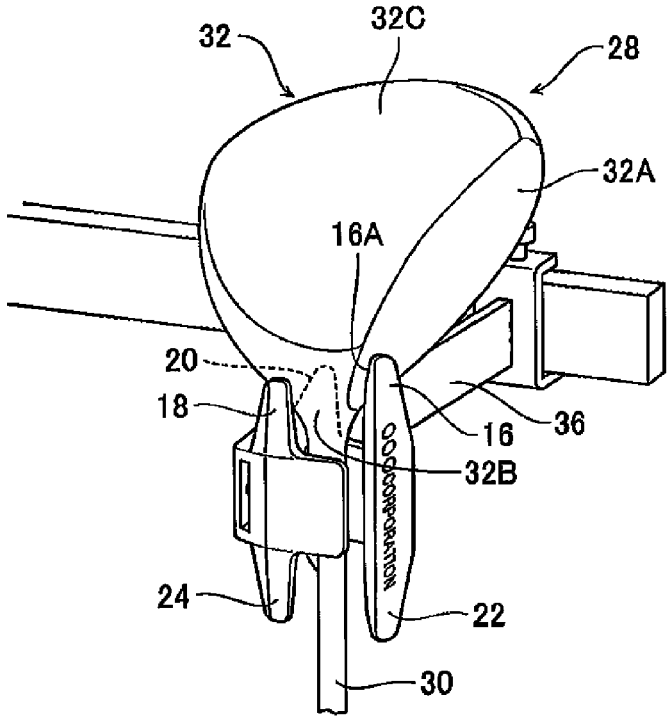
FIG. 6 is a view corresponding to FIG. 1 of the golf club support according to the first embodiment being, in a state of supporting a wooden club.
Figure 7:
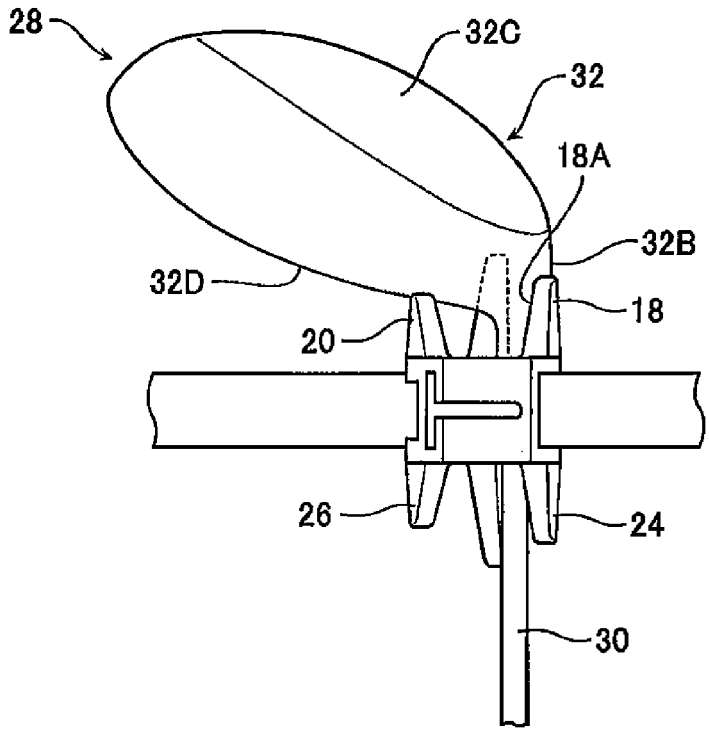
FIG. 7 is a view corresponding to FIG. 3 of the golf club support according to the first embodiment being in a state of supporting a wooden club.

In the wooden club support according to the first embodiment, the first support pole 16 projects upward from the top surface of one edge 10A of the opening 10, the second support pole 18 projects from the top surface of the other edge 10B of the opening 10 close to an innermost portion 12A of the guide portion 12, and the third support pole 20 projects from a position that is opposite to the second support pole 18 with respect to an extended line of a direction running from the first support pole 16 to the guide portion 12. The first support pole 16 is taller than the second support pole 18, and the second support pole 18 is taller than the third support pole 20. At the top end of the first support pole 16 and the second support pole 18, the sides of the inner surface and left side surface of the pole are chamfered, whereby a tapered surface 16A that faces obliquely inward and upward is formed. As shown in FIGS. 6 and 7, the first support pole 16, the second support pole 18, and the third support pole 20 are positioned such that when a shaft 30 of a wooden club 28 is inserted into the guide portion 12 and positioned at the innermost portion 12A of the guide portion 12, the tapered surface 16A of the first support pole 16 supports a face surface 32A of a head portion 32 of the wooden club 28, an inner surface 18A of the second support pole 18 supports a side surface of the head portion 32 on the base end side, more specifically, a surface 32B that faces obliquely outward and upward, and the top end of the third support pole 20 supports the top surface (i.e., the surface opposite to a sole surface 32C) 32D of the head portion 32.

Figure 8:
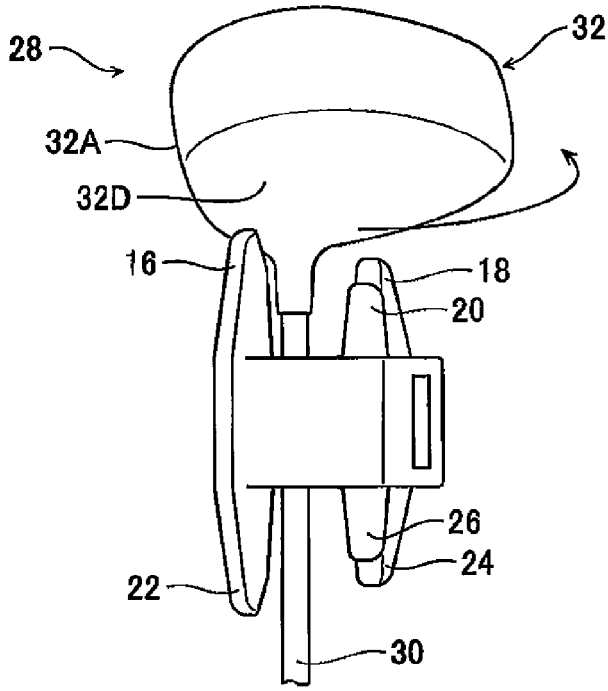
FIG. 8 is a perspective view showing a state that a head portion of a wooden club is placed on the top end of a first support pole of the golf club support according to the first embodiment.
Figure 9:
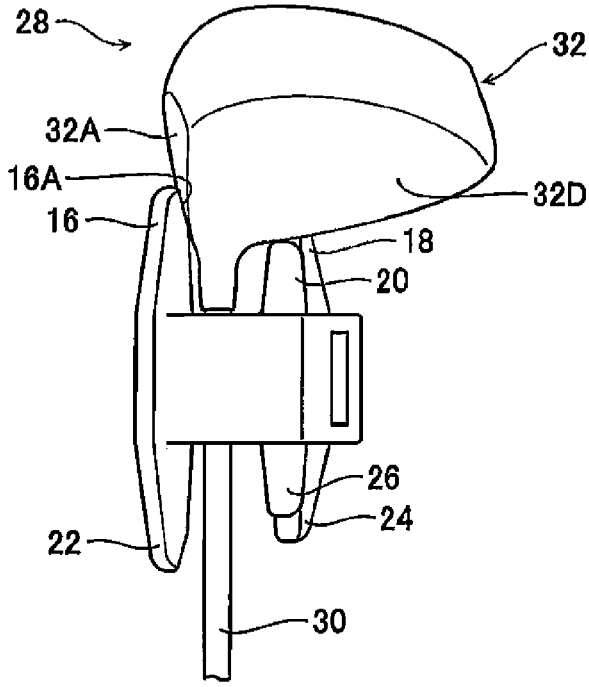
FIG. 9 is a perspective view showing a state that a head portion of a wooden club is positioned on the top end of a third support pole of the golf club support according to the first embodiment.
Figure 10:
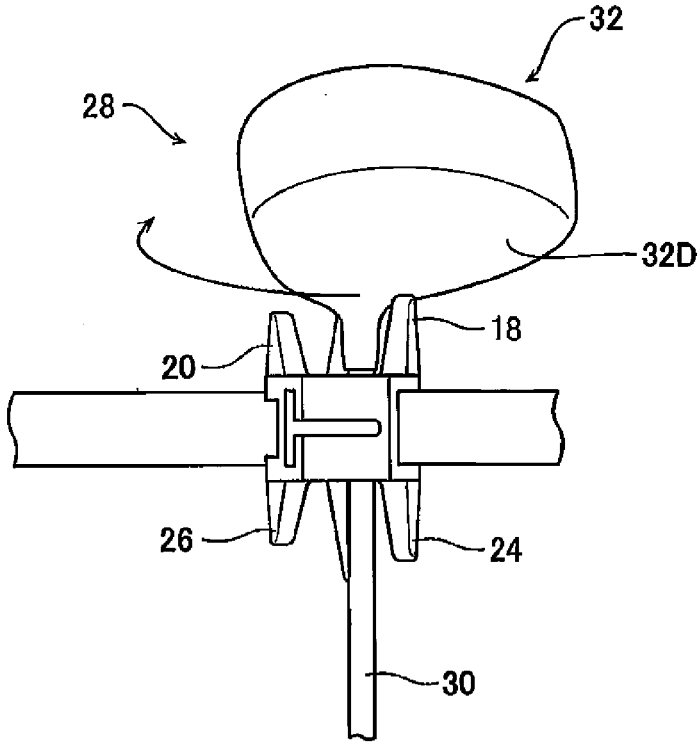
FIG. 10 is a perspective view showing a state that a head portion of a wooden club is placed on the top end of a second support pole of the golf club support according to the first embodiment.

According to this length and positional configuration of the first support pole 16, the second support pole 18, and the third support pole 20, even if, for example, the shaft 30 of the wooden club 28 is positioned at the innermost portion 12A of the guide portion 12 and the top surface 32D of the head portion 32 is placed on the top end of the first support pole 16 as shown in FIG. 8, as long as the position at which the first support pole 16 and the head portion 32 contact each other is distal from the topmost portion of the top surface 32D of the head portion 32, the top end of the first support pole 16 that is higher than the top end of the third support pole 20 causes the head portion 32 to slide down toward the third support pole 20 (in the direction of the arrow of FIG. 8) to be supported by the third support pole 20 as shown in FIG. 9. Further, even if, for example, the shaft 30 of the wooden club 28 is positioned at the innermost portion 12A of the guide portion 12 and the top surface 32D of the head portion 32 is placed on the top end of the second support pole 18 as shown in FIG. 10, as long as the position at which the second support pole 16 and the head portion 32 contact each other is distal from the topmost portion of the top surface 32D of the head portion 32, the top end of the second support pole 18 that is higher than the top end of the third support pole 20 causes the head portion 32 to slide down toward the third support pole 20 (in the direction of the arrow of FIG. 10) to be supported by the third support pole 20. In the wooden club support according to the first embodiment, the top ends of all of the first to third support poles 16, 18, and 20 are formed into an R shape. The top ends having an R shape facilitate the movement of the head portion 32 of sliding down toward the third support pole 20.

The fourth support pole 22, the fifth support pole 24, and the sixth support pole 26 are formed on the bottom surface of the support body 14 to have the same heights and be at the same positions as those of the first support pole 16, the second support pole 18, and the third support pole 20. When the bottom surface of the support 14 is turned upward, the fourth support pole 22, the fifth support pole 24, and the sixth support pole 26 can support a wooden club for left-handers in the same way as the first support pole 16, the second support pole 18, and the third support pole 20 do.

A vertically-long rectangular aperture 34 is formed in both surfaces 14D and 14E that adjoin a surface 14C opposite to the opening 10 of the support body 14, at a portion close to the surface 14C, such that the aperture 34 penetrates both the surfaces 14D and 14E. The golf club support according to the first embodiment is configured to be set on a display stand or the like, with a plate-like support bar 36 that extends horizontally from the display stand or the like inserted into the aperture 34 as shown in FIG. 6. Since the aperture 34 has a vertically-long rectangular shape and the support bar 36 has a plate-like shape as described above, the fourth support pole 22, the fifth support pole 24, and the sixth support pole 26 can be set to face upward, which enables to support a wooden club for left-handers.

In the golf club support according to the first embodiment, the first support pole 16, the fourth support pole 22, and the outer side of the one edge 10A of the opening 10 form one continuous surface, and this surface is inclined toward the opening 10. In this way, by forming one continuous surface at the outer side and inclining the surface toward the opening 10, it becomes possible to present a company name or its logo as shown in FIG. 1.

Figure 11:
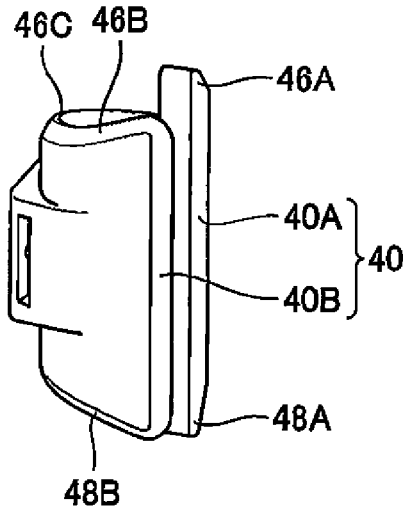
FIG. 11 is a perspective view of a second embodiment of a golf club support according to the present invention.
Figure 12:
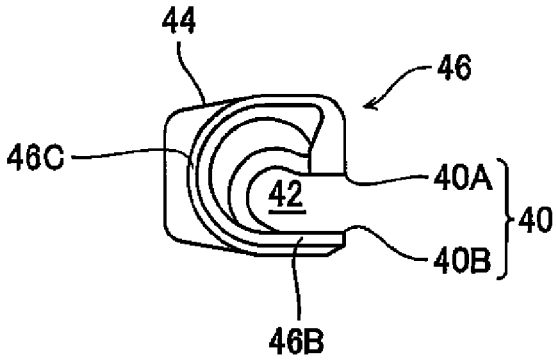
FIG. 12 is a top view of the golf club support according to the second embodiment.
Figure 13:
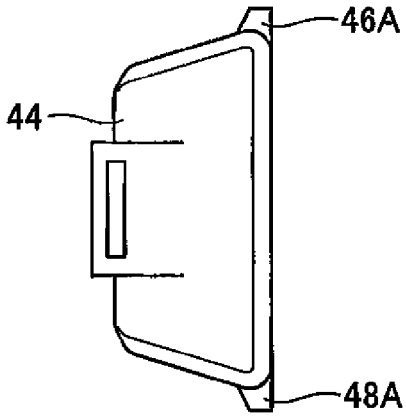
FIG. 13 is a front view of the golf club support according to the second embodiment.
Figure 14:
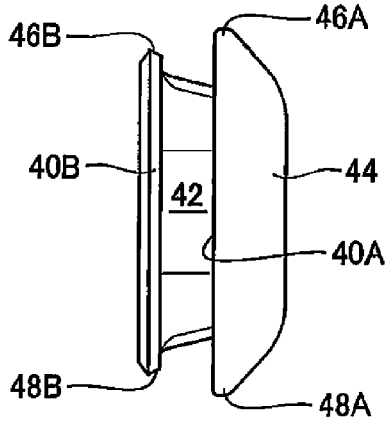
FIG. 14 is a right side view of the golf club support according to the second embodiment.
Figure 15:
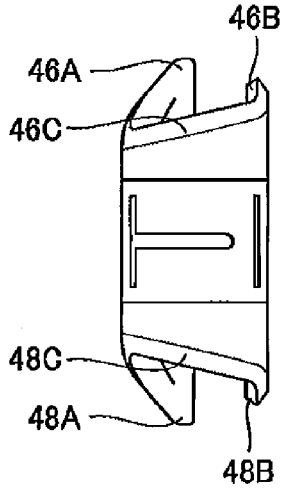
FIG. 15 is a left side view of the golf club support according to the second embodiment.

Next, a second embodiment of a golf club support according to the present invention will be explained. FIG. 11 is a perspective view of a wooden club support according to the second embodiment. FIG. 12 is a top view thereof. FIG. 13 is a front view thereof. FIG. 14 is a right side view thereof. FIG. 15 is a left side view thereof.

Like the first embodiment, the wooden club support according to the second embodiment includes: a columnar support body 44 having an opening 40 and a guide portion 42; a first rim 46 projecting upward from the top surface of the support body 44 and conforming to the shape of the guide portion; and a second rim 48 projecting downward from the bottom surface of the support body 44 and conforming to the shape of the guide portion.

Figure 16:
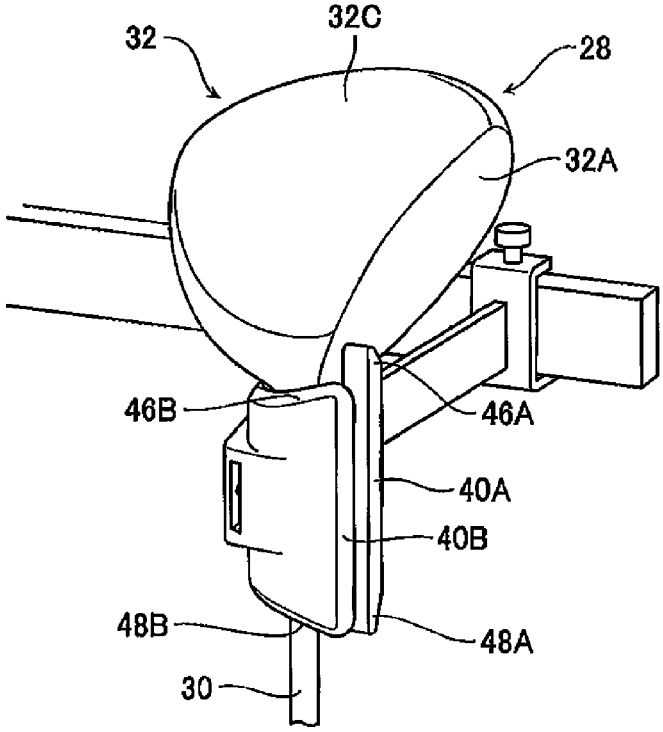
FIG. 16 is a view corresponding to FIG. 1 of the golf club support according to the second embodiment being in a state of supporting a wooden club.

In the wooden club support according to the second embodiment, the first rim 46 is formed such that when the shaft of a wooden golf club is positioned at the innermost portion of the guide portion, a first support portion 46A, which is a portion continuous from an edge 40A of the first rim 46 at the right-hand side of the opening 40, supports the face surface of the head portion of the wooden golf club, a second support portion 46B, which is a portion continuous from an edge 40B of the first rim 46 at the left-hand side of the opening 40, supports the base-end-side side surface of the head portion of the wooden golf club, and a third support portion 46C, which is a remaining portion of the first rim 46, supports the top surface of the head portion of the wooden golf club, as shown in FIG. 16. In the wooden club support according to the second embodiment, the first support portion 46A is taller than the second support portion 46B, the second support portion 46B is taller than the third support portion 46C, and a tapered surface that faces obliquely inward and upward is formed at the inner side of the top end of the first support portion 46A.

According to this formation of the first rim 46, even if, for example, the shaft 30 of the wooden club 28 is positioned at the innermost portion 42A of the guide portion 42 and the top surface 32D of the head portion 32 is placed on the top end of the first support portion 46A, as long as the position at which the first support portion 46A and the head portion 32 contact each other is distal from the topmost portion of the top surface 32D of the head portion 32, the top end of the first support portion 46A that is higher than the top end of the third support portion 46C causes the head portion 32 to slide down toward the third support portion 46C to be supported by the third support portion 46C. Further, even if, for example, the shaft 30 of the wooden club 28 is positioned at the innermost portion 12A of the guide portion 12 and the top surface 32D of the head portion 32 is placed on the top end of the second support portion 46B, as long as the position at which the second support portion 46B and the head portion 32 contact each other is distal from the topmost portion of the top surface 32D of the head portion 32, the top end of the second support portion 46B that is higher than the top end of the third support portion 46C causes the head portion 32 to slide down toward the third support portion 46C to be supported by the third support portion 46C.

The second rim 46 symmetrical with the first support portion 46A, the second support portion 46B, and the third support portion 46C of the first rim 46 likewise has a first support portion 48A, a second support portion 48B, and a third support portion 48C. When the bottom surface of the support 44 is turned upward, the first support portion 48A, the second support portion 48B, and the third support portion 48C of the second rim 48 can support a wooden club for left-handers in the same way as those of the first rim 46 do.

The invention claimed is:

1. A golf club support for supporting a golf club of which head portion has an R shape on a base end side, wherein the golf club support has a columnar shape, has an opening which extends from a top end to a bottom end in a circumferential surface thereof, and has a guide portion which is formed from the opening toward the inside to be able to guide a shaft of the golf club therein, a first support member, a second support member, and a third support member are formed on at least a top surface of the golf club support such that when the golf club is positioned at an innermost portion of the guide portion with a sole surface of its head portion turned upward, the first support member supports a face surface of the head portion of the golf club, the second support member supports a surface facing obliquely outward and upward in a base-end-side side surface of the head portion of the golf club, and the third support member supports a top surface of the head portion of the golf club on a top end thereof, and positions of top portions of the first support member and the second support member are higher than a top portion of the third support member, wherein at least three support, poles project upward from the top surface of the golf club support, and among the at least three support poles, a first support pole functions as the first support member, a second support pole functions as the second support member, and the support pole other than the first support pole and the second support pole functions as the third support member.

2. The golf club support according to claim 1, wherein a tapered surface that faces obliquely inward and upward is formed on an inner side of a top end of the first support member, and the golf club support is configured to support the face surface on the tapered surface.

3. The golf club support according to claim 1 or 2, wherein a fourth support member, a fifth support member, and a sixth support member are formed on a bottom surface of the golf club support such that when the golf club is positioned at the innermost portion of the guide portion with the sole surface of its head portion turned upward, the fourth support member supports the face surface of the head portion of the golf club, the fifth support member supports the surface facing obliquely outward and upward in the base-end-side side surface of the head portion of the golf club, and the sixth support member supports the top surface of the head portion of the golf club on a top end thereof, and the fourth support member, the fifth support member, and the sixth support member are formed at positions at which they are symmetrical with the first support member, the second support member, and the third support member respectively.

4. The golf club support according to claim 3, wherein the golf club support is configured to be able to support with any of the top surface and the bottom surface thereof turned upward.

5. The golf club support according to claim 1 or 2, wherein the first support pole and the second support pole have different heights.

6. The golf club support according to claim 1 or 2.

wherein the first support pole and the second support pole are positioned closer to both edges of the opening respectively than the support pole other than them is.

7. The golf club support according to claim 1 or 2, wherein leading ends of the at least three support poles are formed into an R shape or a sharpened shape.

* * * * *